US010518954B2

(12) United States Patent
Wu

(10) Patent No.: US 10,518,954 B2
(45) Date of Patent: Dec. 31, 2019

(54) PACKING BUFFERING DEVICE

(71) Applicant: Chun-Hung Wu, New Taipei (TW)

(72) Inventor: Chun-Hung Wu, New Taipei (TW)

( * ) Notice: Subject to any disclaimer, the term of this patent is extended or adjusted under 35 U.S.C. 154(b) by 69 days.

(21) Appl. No.: 16/008,608

(22) Filed: Jun. 14, 2018

(65) Prior Publication Data

US 2019/0106259 A1 Apr. 11, 2019

(30) Foreign Application Priority Data

Oct. 11, 2017 (CN) ..... 2017 2 1306841 U

(51) Int. Cl.
*B65D 81/05* (2006.01)
*B65D 85/48* (2006.01)

(52) U.S. Cl.
CPC ..... *B65D 81/054* (2013.01); *B65D 85/48* (2013.01)

(58) Field of Classification Search
CPC .... B65D 81/054; B65D 85/48; B65D 81/055; B65D 81/056; B65D 81/05
USPC ..... 206/454, 521, 583, 586, 591, 594
See application file for complete search history.

(56) References Cited

U.S. PATENT DOCUMENTS 3,262,598 A * 7/1966 Carder ..... B65D 81/07 217/53
3,854,579 A * 12/1974 Scharre ..... B65D 5/5033 206/320
4,979,620 A * 12/1990 Delamare ..... B65D 81/05 206/594
5,119,936 A * 6/1992 Sevey ..... G01C 9/28 206/349
5,139,153 A * 8/1992 Delamare ..... B65D 81/05 206/521
5,560,507 A * 10/1996 Arpin ..... B65D 85/48 206/454
6,685,021 B2 * 2/2004 Dodson ..... B65D 61/00 206/391
2010/0187149 A1 * 7/2010 Tsukii ..... B65D 5/5035 206/521
2010/0276331 A1 * 11/2010 Fan ..... B65D 5/5069 206/591
2011/0183089 A1 * 7/2011 Kuo ..... B65D 81/055 428/34.1
2011/0290699 A1 * 12/2011 Golias ..... B65D 81/054 206/586
2016/0194134 A1 * 7/2016 Chang ..... B65D 81/022 206/521

* cited by examiner

*Primary Examiner* — Chun Hoi Cheung
(74) *Attorney, Agent, or Firm* — Muncy, Geissler, Olds & Lowe, P.C.

(57) ABSTRACT

A packing buffering device adapted to surrounding a plate device includes a first hollow connecting rod having a first body, a first connecting portion, and a first fixing portion and a second hollow connecting rod having a second body, a second connecting portion, and a second fixing portion. The first connecting portion and the first fixing portion are respectively extended and bent from two opposite ends of the first body and in contact with the frame of the plate device. The second connecting portion and the second fixing portion are respectively extended and bent from two opposite ends of the second body and in contact with the frame of the plate device. The first body and the second body are above the plate device and not in contact with the plate device. The distance between the fixing portions is less than the distance between the connection portions.

14 Claims, 11 Drawing Sheets

PACKING BUFFERING DEVICE

CROSS-REFERENCE TO RELATED APPLICATION

This non-provisional application claims priority under 35 U.S.C. § 119(a) to Patent Application No. 201721306841.0 filed in China, P.R.C. on Oct. 11, 2017, the entire contents of which are hereby incorporated by reference.

BACKGROUND

Technical Field

The instant disclosure relates to packing fields, in particular, to a packing buffering device.

Related Art

In general, a plate device, e.g., an LCD TV with display panel, a display, or a glass frame, has to be packed with a paper box or a paper case before the device is shipped. Furthermore, buffering materials are applied at the periphery of the plate device as well as in the interior of the paper box or case, and the buffering materials are in direct contact with the plate device to reduce the damage of the plate device during the delivery. Concerning to environmental issues, laws and provisions for packing become stricter and stricter all over the world, and the buffering materials for packing are also requested to be natural-degradable. As a result, materials which are hard to be degradable naturally, such as polystyrene foam blocks and plastics, are gradually restricted. Nevertheless, when the buffering materials are in direct contact with the plate device, the plate device may still suffer stresses from different aspects. Therefore, the plate device would be forced during the storage or transportation and thus may be damaged because of the compression caused by the force. Moreover, when several packed plate devices are to be stacked with pallets, the height of the pallet and the number of the pallet layers are also restricted because of the stresses applied to the packed plate devices. Furthermore, when the plate devices are unpacked, the plate devices cannot be supported and fixed in properly and may be fell off, broken, or damaged.

In practices of industrial production, transportation, and marketing, the cost of packing materials relative to overall manufacturing cost is apparently higher than before. Furthermore, the materials used for packing and the amount of the used packing materials are environmentally concerned. Hence, laws and provisions all over the world ask the industries the amount of the packing materials to be reduced as well as the properties of the buffering materials to be ecofriendly. However, along with the restriction and reduction of the buffering materials, the packed products cannot be supported properly. Take plate devices as an instance, as mentioned, the plate devices would be forced during the storage or the transportation and thus may be damaged because of the compression caused by the force, and when the plate devices are unpacked, the plate devices cannot be supported and fixed in properly and may be fell off, broken, or damaged. As a result, compared with devices packed with buffering materials, the number of the damaged or broken devices which is not packed with buffering materials is greatly increased.

Recently, plate devices are designed to be thin and large scaled. As a result, the conventional packing and delivery operations are not suitable for these devices. Manufacturers had some approaches to prevent the devices from being compressed and fell off. For example, a frequently adopted technique is applying different elastic and compressible materials, e.g., mold pulps, buffer blocks, bubble wraps, around the devices for buffering and protection. This technique may provide some protection to the devices; however, this technique also causes inconvenience to the operators for unpacking, storing, and delivery. Moreover, this technique may have other problems. For example, the mechanical strength of the packed materials is insufficient, and the packed product may be fell off easily because the gravity center of the packed product is higher.

Recently, damages of the plate devices during the packing, delivery, and demonstration increase apparently. For example, the amount of the LCD display being damaged during the packing, delivery, and demonstration stages is as high as 8%. The manufacturing, packing, work force, delivery, storage, management, or recycling of the damaged products belong to sunk costs. As a result, the unit manufacturing cost is greatly increased. Since more and more plate devices are available in the markets, the cost of the damaged devices becomes an issue. Accordingly, industries develop next-generation packing materials to overcome the current problems. For example, in the first quarter of 2013, a semiconductor company launched large-scale panel TVs in Taiwan, and about tens of thousands large-scale panel TVs are sold. Conventional packing materials were not applicable for the specifications of these panel TVs. Therefore, a vehicle company was asked to provide customized delivery services for the customers buying the panel TVs. The vehicle company designed customized vehicles for delivering these products to the buyers' places, and the semiconductor further spent about 30 million NTD for specialized recyclable aluminum-alloy packing boxes in which the quality of aluminum alloy used for producing these packing boxes was the same as the aluminum alloy used for producing casing of cellphones. After the factory manufactured the plate devices, the plate devices were received in high-density containers for delivering the plate devices to the logistics center. Then, a repacking procedure was applied and the plate devices were taken from the high-density containers and repacked by the aforementioned packing boxes one by one in the logistics center for protection, to prevent the display panels on the plate devices from being broken during the delivery process. The total weight of the specialized packing box and the TV is about 60 kilograms, therefore, customers can hardly achieve the delivery task or install the device on their own, and skilled operators are required to handle the whole delivery and installation processes. Consequently, a great change has to be applied to the delivery and installation of the customized products, from the factory end to the customer end, and such specialized sales mode cannot be applied in normal marketing modes.

SUMMARY

In view of these, a packing buffering device is provided. In one embodiment, the packing buffering device is provided for surrounding or supporting a plate device. The plate device comprises a plate body and a frame. The frame surrounds the periphery of the plate body and a height of the frame is greater than a height of the plate body. The packing buffering device comprises a first hollow connecting rod and a second hollow connecting rod. The first hollow connecting rod comprises a first body, a first connecting portion, and a first fixing portion. The first connecting rod is extended and bent from one of two ends of the first body, and the first connecting rod is in contact with the frame. The first fixing portion is extended and bent from the other end of the first body opposite to the first connecting portion, and the first fixing portion is in contact with the frame. The first body is above the plate body and not in contact with the plate body. The second hollow connecting rod comprises a second body, a second connecting portion, and a second fixing portion. The second connecting portion is extended and bent from one of two ends of the second body, and the second connecting portion is in contact with the frame. The second fixing portion is extended and bent from the other end of the second body opposite to the second connecting portion, and the second fixing portion is in contact with the frame. The second body is above the plate body and not in contact with the plate body. The first fixing portion and the second fixing portion are at one of two opposite edges of the plate device. The first connecting portion and the second connecting portion are at the other edge of the plate device opposite to the first fixing portion and the second fixing portion. A distance between the first fixing portion and the second fixing portion is less than a distance between the first connecting portion and the second connecting portion.

In one or some embodiments, the frame comprises a first side wall, a second side wall, a third side wall, and a fourth side wall. The first side wall and the second side wall are respectively connected to the third side wall and the fourth side wall. The first side wall is opposite to the second side wall, and the first fixing portion and the second fixing portion are in contact with the second side wall. Furthermore, the first connecting and the second connecting portion are in contact with the first side wall. In some other embodiments, the first connecting portion is at a connection between the first side wall and the third side wall, and the second connecting portion is at a connection between the first side wall and the fourth side wall.

Furthermore, the packing buffering device further comprises a third hollow connecting rod and a fourth hollow connecting rod. In one or some embodiments, the third hollow connecting rod comprises a third body, a third connecting portion, and a third fixing portion. The third connecting portion is extended and bent from one of two ends of the third body, and the third connecting portion is in contact with the first side wall of the frame. The third fixing portion is extended and bent from the other end of the third body opposite to the third connecting portion, and the third fixing portion is in contact with the second side wall of the frame. The third body is above the plate body and not in contact with the plate body. The fourth hollow connecting rod comprises a fourth body, a fourth connecting portion and a fourth fixing portion. The fourth connecting portion is extended and bent from one of two ends of the fourth body, and the fourth connecting portion is in contact with the first side wall of the frame. The fourth fixing portion is extended and bent from the other end of the fourth body opposite to the fourth connecting portion, and the fourth fixing portion is in contact with the second side wall of the frame. The fourth body is above the plate body and not in contact with the plate body. The third body, the fourth body, the first body, and the second body are at a same side of the plate device. The third body and the fourth body are between the first body and the second body. A distance between the third fixing portion and the fourth fixing portion is greater than a distance between the third connecting portion and the fourth connecting portion. In one or some other embodiments, the first body and the second body are at one of two sides of the plate device, and the third body and the fourth body are at the other side of the plate body opposite to the first body and the second body.

In one or some embodiments, the packing buffering device further comprises a first buffering pad, a second buffering pad, and a third buffering pad. The first buffering pad is at the connection between the first side wall and the third side wall. The second buffering pad is at the connection between the first side wall and the fourth side wall. The third buffering pad is at the second side wall. The first connecting portion is engaged with the first buffering pad, the second connecting portion is engaged with the second buffering pad, and the first fixing portion and the second fixing portion are engaged with the third buffering pad. Furthermore, the first buffering pad has a first slot, and a first portion of the first body and the first connecting portion are received in the first slot. The second buffering pad has a second slot, and a first portion of the second body and the second connecting portion are received in the second slot. The third buffering pad has two third slots, a second portion of the first body and the first fixing portion are received in one of the two third slots, and a second portion of the second body and the second fixing portion are received in the other third slot. The buffering pad may be made of polygonal paper tubes or pulp molds.

In one or some embodiments, at least one of the first connecting portion, the second connecting portion, the first fixing portion, the second fixing portion, the third connecting portion, the third fixing portion, the fourth connecting portion, and the fourth fixing portion has an opening. The packing buffering device further comprises at least one positioning pin and at least one string, a portion of the string is in the opening and the slit of the positioning pin, and the positioning pin is inserted into the opening to fix the string in the opening. In one or some embodiments, at least one of the first connecting portion, the second connecting portion, the first fixing portion, and the second fixing portion has an opening. The packing buffering device further comprises at least one positioning pin and at least one string, a portion of the string is in the opening, and the positioning pin is inserted into the opening to fix the string in the opening.

According to some embodiments of the instant disclosure, the stress generated during the delivery, the charging, or the stacking operation can be dispersed to prevent the plate device from being broken. Moreover, the height and the number of the stacked goods can be increased. The positioning pin can be inserted into the opening to position the string in the opening, so that the plate device can be fixed with a backboard, a wall or a display window, for supporting and protecting the plate device. Hence, no matter in the plate devices are received in freight containers during logistics process, stored in the store, or displayed in the display window, the plate device can be protected by the packing buffering device. Therefore, the ratio of the defect products can be reduced for lowering the marketing costs.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
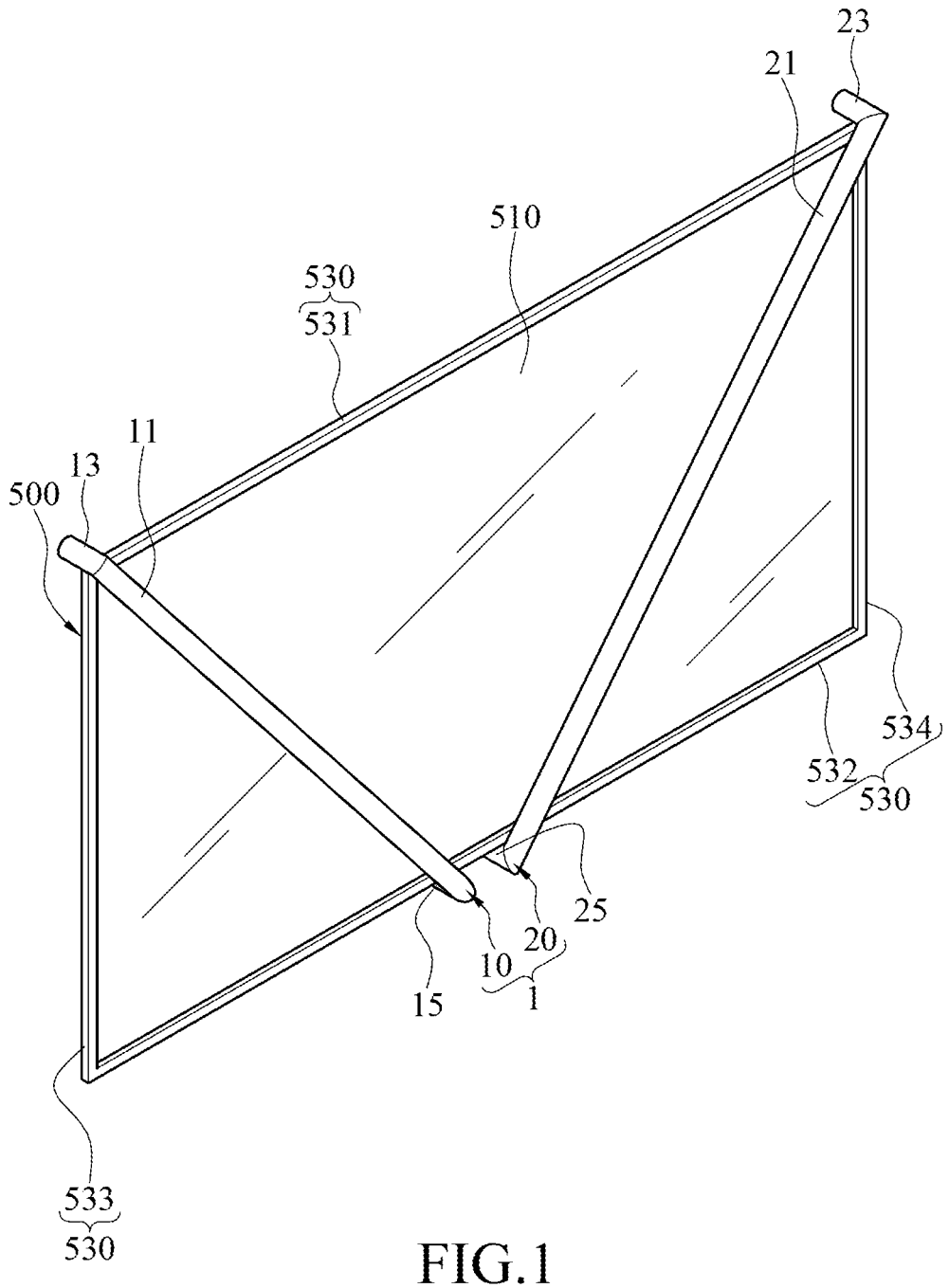
FIG. 1 illustrates a perspective view of a packing buffering device according to a first embodiment of the instant disclosure.
Figure 2:
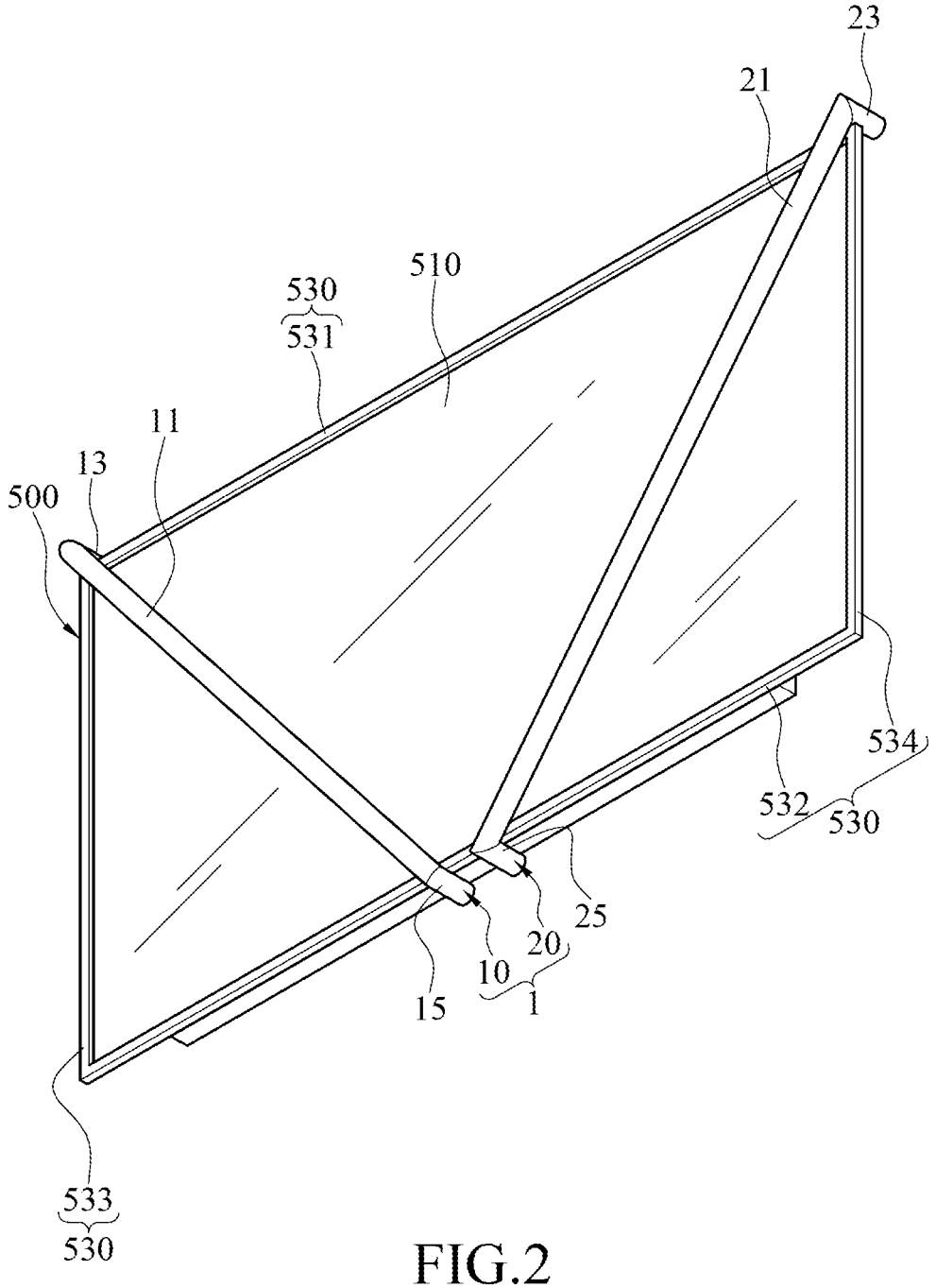
FIG. 2 illustrates another perspective view of the packing buffering device of the first embodiment.

FIG. 1 illustrates a perspective view of a packing buffering device according to a first embodiment of the instant disclosure. FIG. 2 illustrates another perspective view of the packing buffering device of the first embodiment. As shown in FIGS. 1 and 2, the packing buffering device 1 is adapted to supporting a plate device 500. The plate device 500 comprises a plate body 510 and a frame 530. The frame 530 surrounds a periphery of the plate body 510, and a height of the frame 530 is greater than the height of the plate body 510. In this embodiment, the plate device 500 is a display device and the plate body 510 is a display panel, but embodiments are not limited thereto. For example, the plate device 500 may be a photo frame or a picture frame, etc. The packing buffering device 1 comprises a first hollow connecting rod 10 and a second hollow connecting rod 20.

The first hollow connecting rod 10 comprises a first body 11, a first connecting portion 13, and a first fixing portion 15. The first connecting portion 13 is extended and bent from one of two ends of the first body 11, and the first connecting portion 13 is in contact with the frame 530. The first fixing portion 15 is extended and bent from the other end of the first body 11 opposite to the first connecting portion 13, and the first fixing portion 15 is in contact with the frame 530. In other words, the first connecting portion 13 and the first fixing portion 15 are respectively at two ends of the first body 11. The first body 11 is above the plate body 510, and the first body 11 is not in contact with the plate body 510. The second hollow connecting rod 20 comprises a second body 21, a second connecting portion 23, and a second fixing portion 25. The second connecting portion 23 is extended and bent from one of two ends of the second body 21, and the second connecting portion 23 is in contact with the frame 530. The second fixing portion 25 is extended and bent from the other end of the second body 21 opposite to the second connecting portion 23, and the second fixing portion 25 is in contact with the frame 530. In other words, the second connecting portion 23 and the second fixing portion 25 are respectively at two ends of the second body 21. The second body 21 is above the plate body 510, and the second body 21 is not in contact with the plate body 510. In this embodiment, the first fixing portion 15 and the second fixing portion 25 are at one of two opposite edges of the plate device 500, and the first connecting portion 13 and the second connecting portion 23 are at the other edge of the plate device 500 opposite to the first fixing portion 15 and the second fixing portion 25. A distance between the first fixing portion 15 and the second fixing portion 25 is less than a distance between the first connecting portion 13 and the second connecting portion 23. In other words, the first hollow connecting rod 10 and the second hollow connecting rod 20 are arranged as a V shape structure on the plate device 500.

In detail, in one embodiment, the frame 530 further comprises a first side wall 531, a second side wall 532, a third side wall 533, and a fourth side wall 534. The first side wall 531 and the second side wall 532 are respectively connected to the third side wall 533 and the fourth side wall 534. The first side wall 531 is opposite to the second side wall 532. In the embodiment shown in FIGS. 1 and 2, the first connecting portion 13 is substantially at the connection between the first side wall 531 and the third side wall 533, the second connecting portion 23 is substantially at the connection between the first side wall 531 and the fourth side wall 534, and the first fixing portion 15 and the second fixing portion 25 are in contact with the second side wall 532, but embodiments are not limited thereto. For example, in the second embodiment shown in FIG. 3, the first connecting portion 13 and the second connecting portion 23 are only in contact with the first side wall 531. In other words, the angle of the V shape structure of the hollow connecting rods 10, 20 in the second embodiment is slightly less than the angle of the V shape structure of the hollow connecting rods 10, 20 in the first embodiment. Furthermore, if the space is available, at least one of the first connecting portion 13, the second connecting portion 23, the first fixing portion 15, and the second fixing portion 25 may be bent to form an L shape hook.

Figure 4:
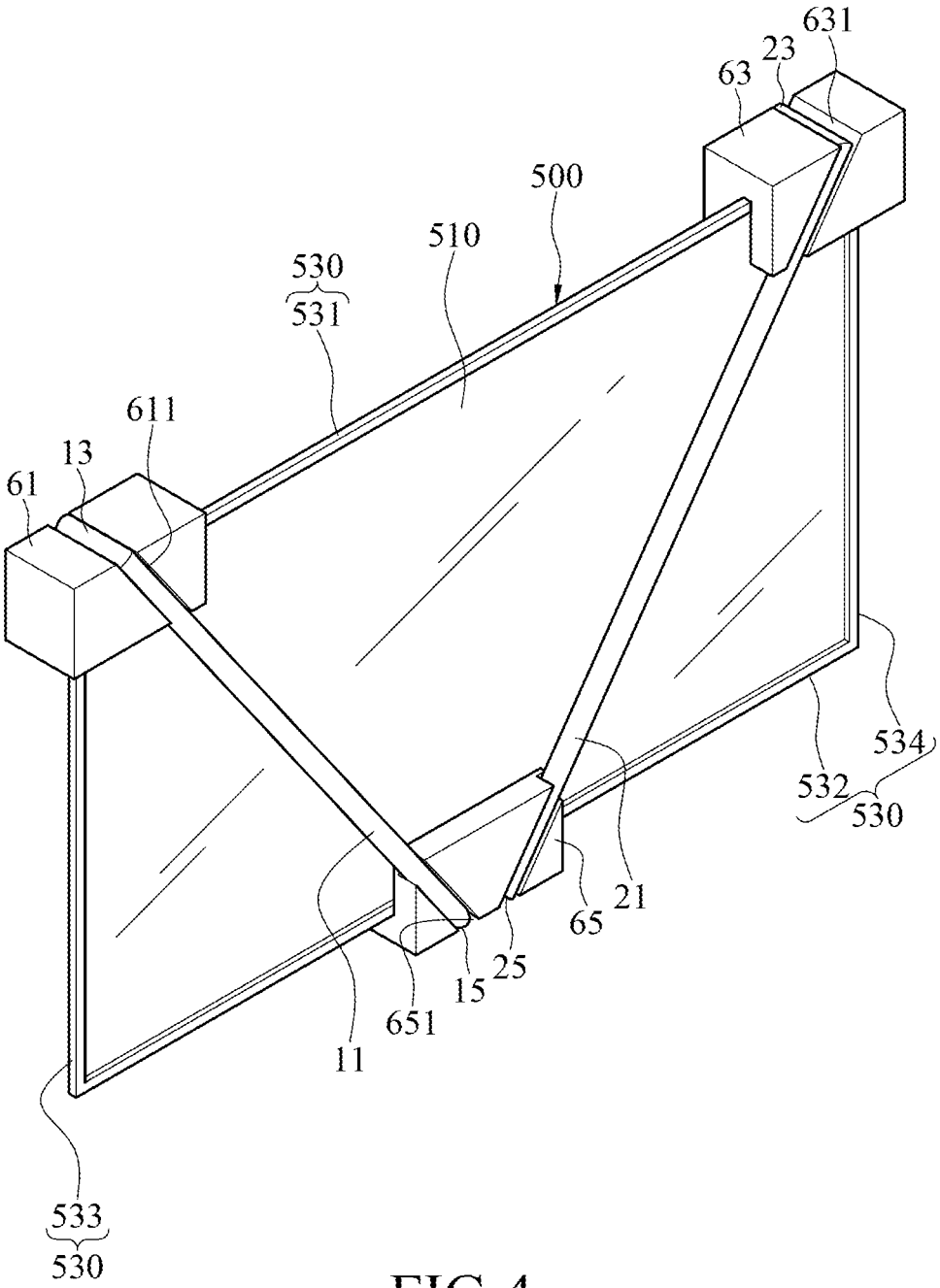
FIG. 4 illustrates a perspective view of a packing buffering device according to a third embodiment of the instant disclosure.

FIG. 4 illustrates a perspective view of a packing buffering device according to a third embodiment of the instant disclosure. As shown in FIG. 4, the packing buffering device 1 may further comprise a first buffering pad 61, a second buffering pad 63, and a third buffering pad 65. In this embodiment, the first buffering pad 61 is at the connection between the first side wall 531 and the third side wall 533. The second buffering pad 63 is at the connection between the first side wall 531 and the fourth side wall 534. The third buffering pad 65 is at the second side wall 532. The first connecting portion 13 is engaged with the first buffering pad 61. The second connecting portion 23 is engaged with the second buffering pad 63. The first fixing portion 15 and the second fixing portion 25 are engaged with the third buffering pad 65. In detail, in one embodiment, the first buffering pad 61 has a first slot 611, and the first slot 611 may be L shaped. A first portion of the first body 11 and the first connecting portion 13 are received in the first slot 611. The second buffering pad 63 has a second slot 631, and the second slot 631 may be L shaped. A first portion of the second body 21 and the second connecting portion 23 are received in the second slot 631. The third buffering pad 65 has two third slots 651, and the third slots 651 may be L shaped. A second portion of the first body 11 and the first fixing portion 15 are received in one of the two third slots 651, and a second portion of the second body 21 and the second fixing portion 25 are received in the other third slot 651.

The foregoing embodiments are provided for illustrative purposes, but not limitations to the instant disclosure. It is understood that the number of the buffering pads, the position of the buffering pads, and the way for positioning the buffering pads with the hollow connecting rods are adjustable. For example, the number of the buffering pads may be changed to four, or the slots may be changed by insertion holes.

Figure 5:
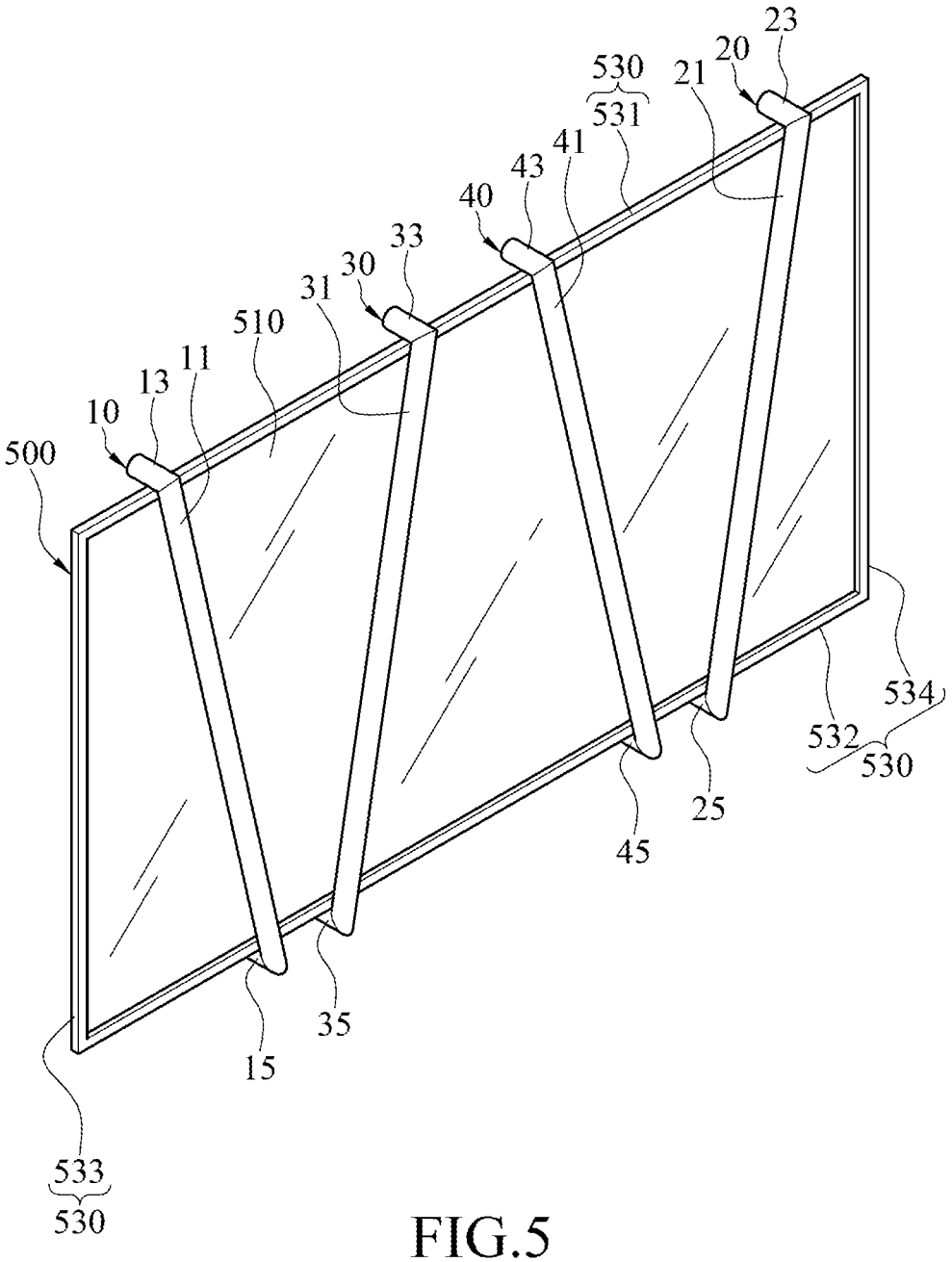
FIG. 5 illustrates a perspective view of a packing buffering device according to a fourth embodiment of the instant disclosure.

FIG. 5 illustrates a perspective view of a packing buffering device according to a fourth embodiment of the instant disclosure. As shown in FIG. 5, the packing buffering device 1 further comprises a third hollow connecting rod 30 and a fourth hollow connecting rod 40. The third hollow connecting rod 30 comprises a third body 31, a third connecting portion 33, and a third fixing portion 35. The third connecting portion 33 is extended and bent from one of two ends of the third body 31, and the third connecting portion 33 is in contact with the first side wall 531 of the frame 530. The third fixing portion 35 is extended and bent from the other end of the third body 31 opposite to the third connecting portion 33, and the third fixing portion 35 is in contact with the second side wall 532 of the frame 530. The third body 31 is above the plate device 510 and not in contact with the plate body 510. The fourth hollow connecting rod 40 comprises a fourth body 41, a fourth connecting portion 43, and a fourth fixing portion 45. The fourth connecting portion 43 is extended and bent from one of two ends of the fourth body 41, and the fourth connecting portion 43 is in contact with the first side wall 531 of the frame 530. The fourth fixing portion 45 is extended and bent from the other end of the fourth body 41 opposite to the fourth connecting portion 43, and the fourth fixing portion 45 is in contact with the second side wall 532 of the frame 530. The fourth body 41 is above the plate body 510 and not in contact with the plate body 510. In this embodiment, the third body 31, the fourth body 41, the first body 11, and the second body 21 are at a same side of the plate device 500. The third body 31 and the fourth body 41 are between the first body 11 and the second body 21. A distance between the third fixing portion 35 and the fourth fixing portion 45 is greater than a distance between the third connecting portion 33 and the fourth connecting portion 43. In other words, the first body 11, the second body 21, the third body 31, and the fourth body 41 are arranged as a W shape structure on the plate device 500. It is understood that, when the packing buffering device 1 and the plate device 500 are received in an outer packing box, the V shape structure or the W shape structure of the hollow connecting rods allow the force applied to the top or the two sides of the plate device 500 to be dispersed or conducted to side walls of the outer packing box through the packing buffering device 1. Therefore, stresses are not retained in the interior of the plate device 500 to prevent the deformation or the breaking of the plate body 510.

Figure 6:
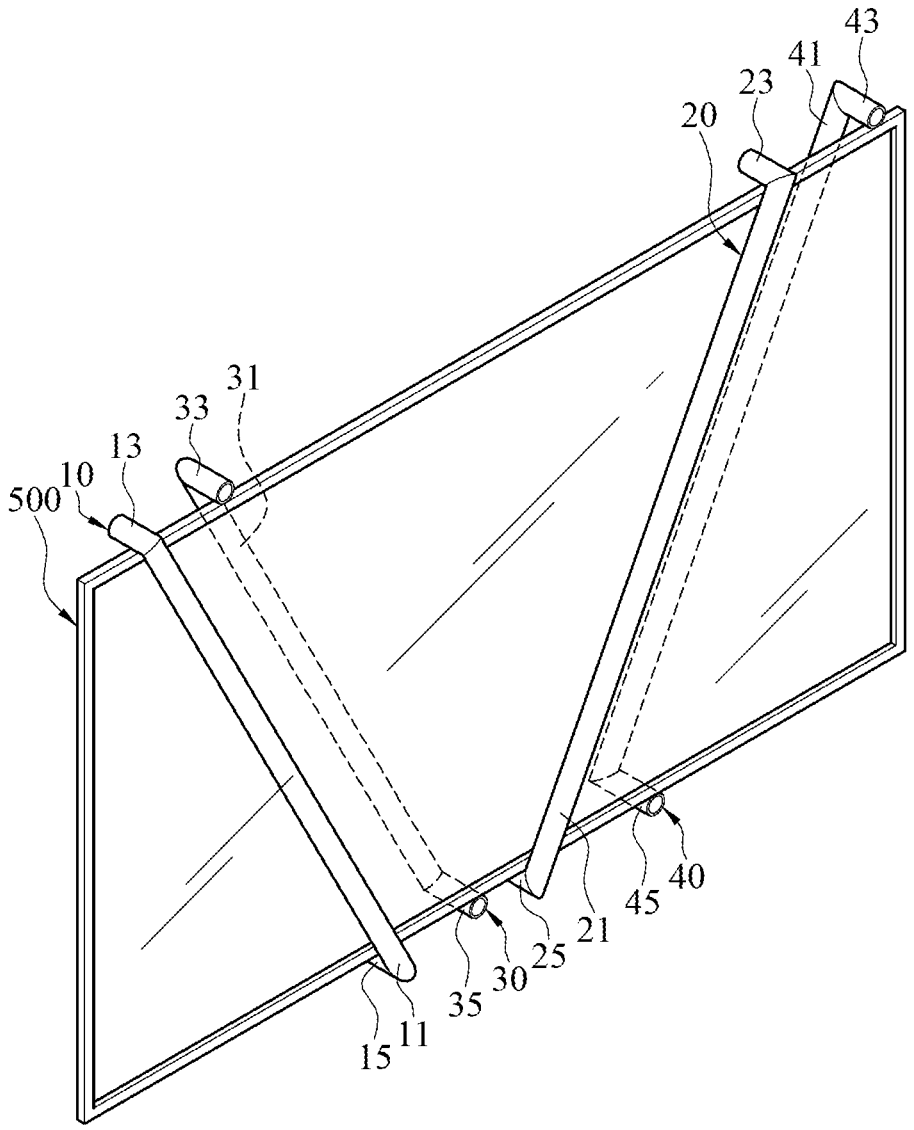
FIG. 6 illustrates a perspective view of a packing buffering device according to a fifth embodiment of the instant disclosure.
Figure 7:
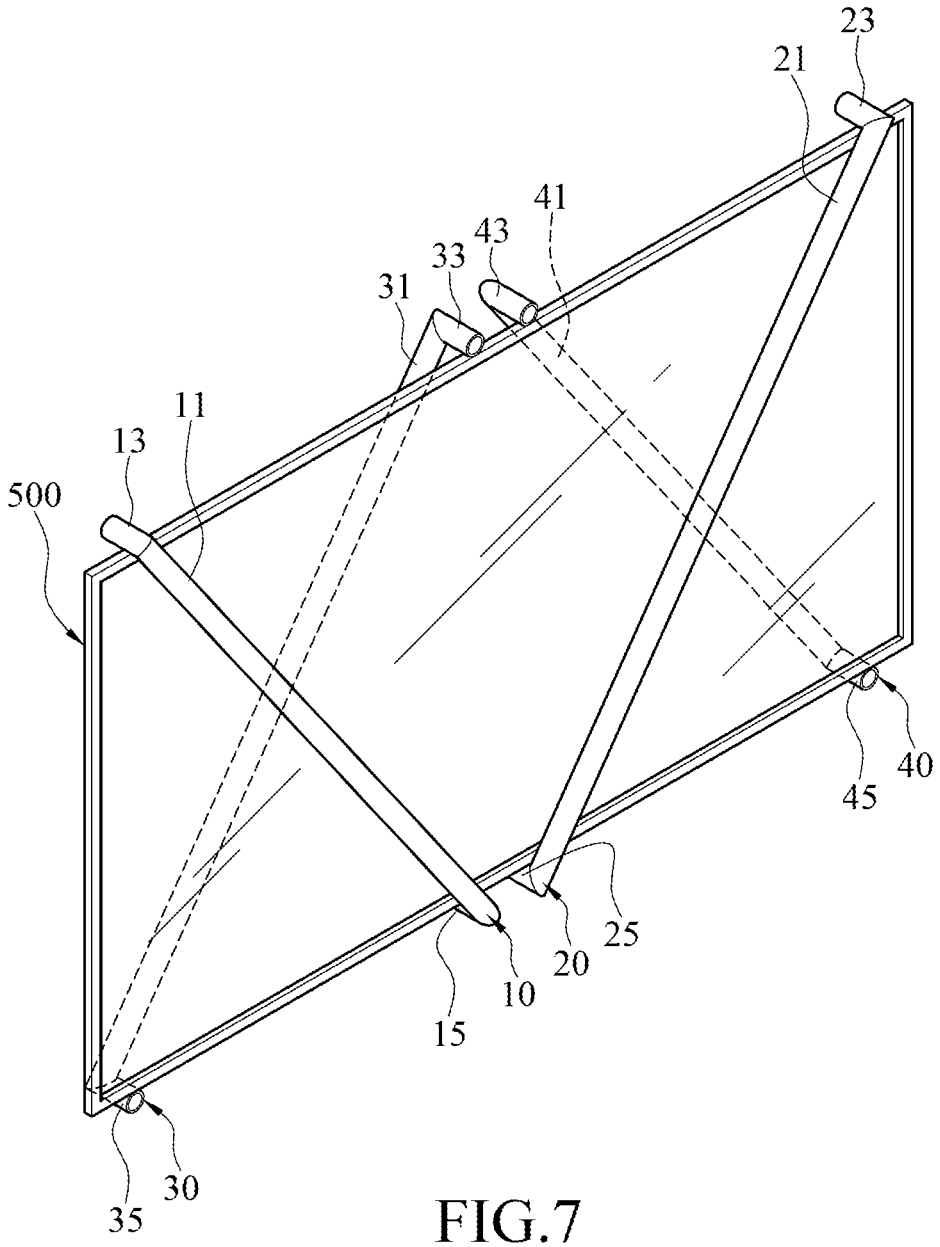
FIG. 7 illustrates a perspective view of a packing buffering device according to a sixth embodiment of the instant disclosure.

FIG. 6 illustrates a perspective view of a packing buffering device according to a fifth embodiment of the instant disclosure. FIG. 7 illustrates a perspective view of a packing buffering device according to a sixth embodiment of the instant disclosure. As shown in FIGS. 6 and 7, similar to the fourth embodiment, the packing buffering device 1 further comprises the third hollow connecting rod 30 and the fourth hollow connecting rod 40. In the embodiments shown in FIGS. 6 and 7, the arrangements between the four hollow connecting rods 10, 20, 30, 40 are different from that of the fourth embodiment. In the embodiments shown in FIGS. 6 and 7, the third body 31 and the fourth body 41 are at one of two sides of the plate device 500, and the first body 11 and the second body 21 are at the other side of the plate device 500 opposite to the third body 31 and the fourth body 41. For example, the first body 11 and the second body 21 are at the front surface of the plate device 500, and the third body 31 and the fourth body 41 are at the rear surface of the plate device 500. Moreover, the third body 31 and the fourth body 41 may be in contact with the back cover of the plate device 500.

As shown in FIG. 6, a projection of the third body 31 and a projection of the first body 11 are parallel in a vertical direction (i.e., a direction parallel to the direction from the front surface of the plate device 500 to the rear surface of the plate device 500), and a projection of the fourth body 41 and a projection of the second body 21 are parallel in the vertical direction. A distance between the third fixing portion 35 and the fourth fixing portion 45 is less than a distance between the third connecting portion 33 and the fourth connecting portion 43. In other words, in this embodiment, the third body 31 and the fourth body 41 are at one of two sides of the plate device 500, and the first body 11 and the second body 21 are at the other side of the plate device 500 opposite to the third body 31 and the fourth body 41, and the hollow connecting rods 10, 20, 30, 40 form V shape structures pointing toward a same direction. As shown in FIG. 7, the projection of the third body 31 and the projection of the first body 11 are crossed with each other in the vertical direction, the projection of the fourth body 41 and the projection of the second body 21 are crossed with each other in the vertical direction, and the distance between the third fixing portion 35 and the fourth fixing portion 45 is greater than the distance between the third connecting portion 33 and the fourth connecting portion 43. In other words, in this embodiment, the third body 31 and the fourth body 41 are at one of two sides of the plate device 500, and the first body 11 and the second body 21 are at the other side of the plate device 500 opposite to the third body 31 and the fourth body 41, and the hollow connecting rods 10, 20, 30, 40 form V shape structures pointing toward opposite directions.

In the foregoing embodiments, the first body 11, the second body 21, the third body 31, or the four body 41 is above one or both the two sides (the front surface and the rear surface) of the plate device 500 to provide a buffering effect for the plate device 500 upon one or both the two sides of the plate device 500 suffers a force. For example, when the plate device 500 packed by the packing buffering device 1 and received in the outer packing box is to be clamped by a fixture device for stacking on pallets or putting in containers, the first body 11, the second body 21, the third body 31, or the fourth body 41 can buffer the force applied to two sides of the plate body 510. Accordingly, the first body 11, the second body 21, the third body 31, or the fourth body 41 can prevent the fixture from being in direct contact with the plate body 510 to avoid the breaking of the plate body 510. Moreover, the first body 11, the second body 21, the third body 31, and the fourth body 41 can disperse the force to the long edges of the plate body 510 to prevent the stresses being concentrated at the short edges of the plate body 510, and to prevent the plate body 510 from being broken. Accordingly, fixture devices like robot arms can be utilized for operating the plate device 500 for stock loading to reduce the labor cost.

In this embodiment, the first hollow connecting rod 10, the second hollow connecting rod 20, the third hollow connecting rod 30, the fourth hollow connecting rod 40, the first buffering pad 61, the second buffering pad 62, and the third buffering pad 63 can be made of molded pulp. Therefore, these components can be recycled and naturally degradable to reduce adverse impacts on the environments. Furthermore, the first hollow connecting rod 10, the second hollow connecting rod 20, the third hollow connecting rod 30, and the fourth hollow connecting rod 40 may be provided as handles for operating the goods during charging or discharging the goods. Hence, the handles allow the operator to perform the task in an ergonomic manner to prevent occurrence of occupational injuries, and the handles reduce the possibility of breaking the plate body during the operation as well.

Figure 3:
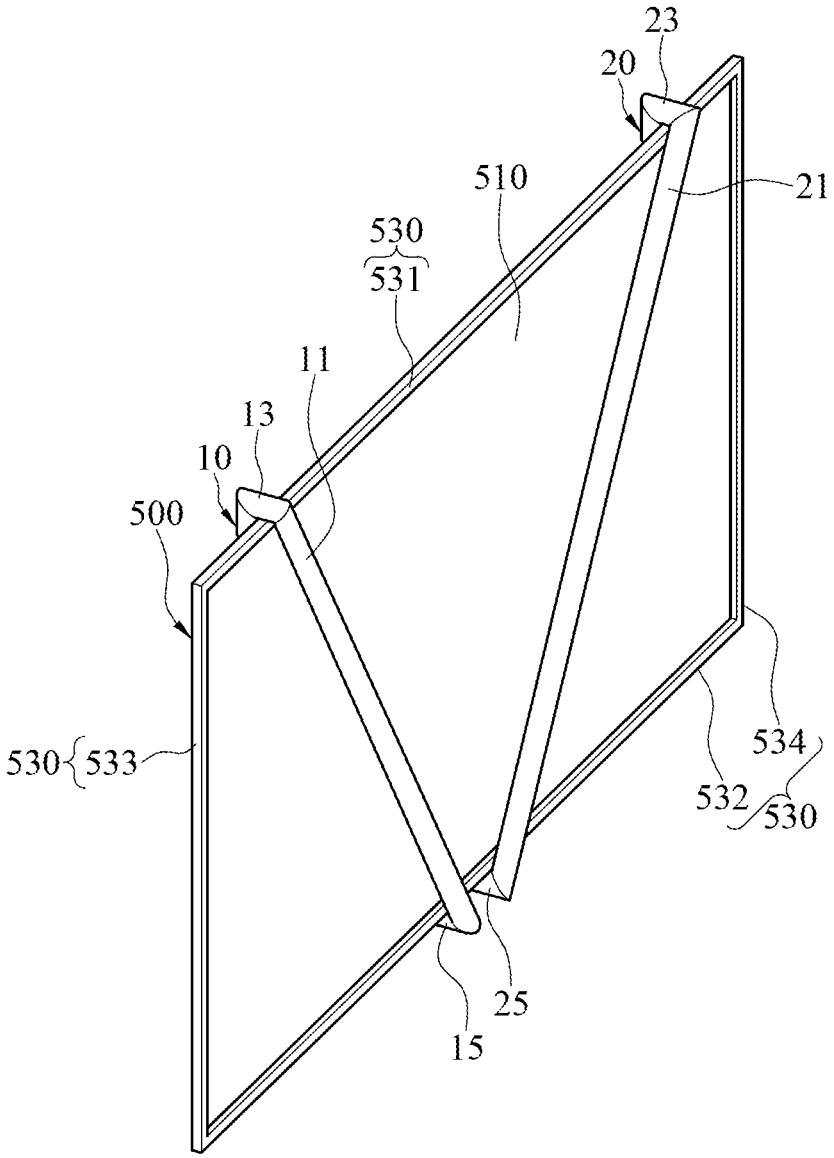
FIG. 3 illustrates a perspective view of a packing buffering device according to a second embodiment of the instant disclosure.

The flexural strengths of the first body, the second body, the third body, and the fourth body are respectively measured by the center point loading method, and the flexural strengths of these components are in the range from 8 to 30 kg. In practice, for a hollow paper tube with an inner diameter of 38 mm, an outer diameter of 44 mm, and a length of 1 m, the flexural strength of the paper tube is measured as 11 kg. In another practice, for a hollow paper tube with an inner diameter of 50 mm, an outer diameter of 56 mm, and a length of 1 m, the flexural strength of the paper tube is measured as 18 kg. As shown in FIG. 1 or 3, the first hollow connecting rod and the second hollow connecting rod are at the same side of the plate body. Therefore, the flexural strength of the side of the plate body having the first hollow connecting rod and the second hollow connecting rod is twice of one hollow connecting rod (the first hollow connecting rod or the second hollow connecting rod), namely, in the range from 16 to 60 kg.

Figure 8:
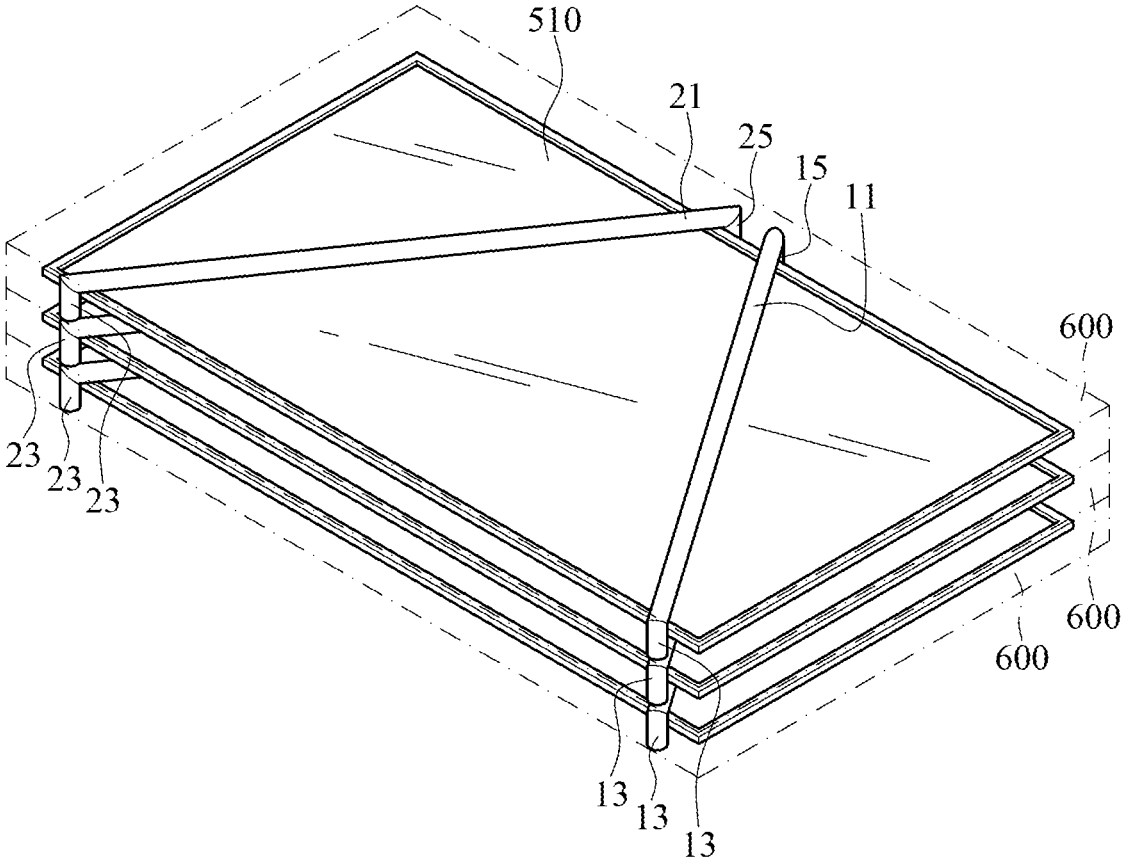
FIG. 8 illustrates a perspective view of several stacked packing buffering devices.

FIG. 8 illustrates a perspective view of several stacked packing buffering devices. As shown in FIG. 8, after the packing buffering device 1 is assembled on the plate device 500, several packing buffering devices 1 and plate devices 500 are received in a box 600. In the box 600, the first connecting portions 13 of the packing buffering devices 1 are aligned along the same vertical line, and the second connecting portions 23, the first fixing portions 15, and the second fixing portions 25 are aligned with each other along the corresponding vertical lines, respectively. Therefore, the weight from the upper assembly of the plate device(s) 500 and the packing buffering device(s) 1 or the weight from the upper box(es) can be transmitted downwardly through the first connecting portions 13, the second connecting portions 23, the first fixing portions 15, and the second fixing portions 25. Therefore, the force is not concentrated on the plate body 510.

As shown in FIGS. 5 to 7, in this embodiment, the compression strengths of the first connecting portion 13, the first fixing portion 15, the second connecting portion 23, the second fixing portion 25, the third connecting portion 33, the third fixing portion 35, the fourth connecting portion 43, and the fourth fixing portion 45 are measured by the compression strength test, and the compression strengths of these components are in the range from 65 to 85 kg. In practice, for a hollow paper tube with an inner diameter of 38 mm, an outer diameter of 44 mm, and a length of 127 mm (5 feet), the compression strength of the paper tube is measured as 73 kg. Therefore, embodiments having the first connecting portion 13, the first fixing portion 15, the second connecting portion 23, and the second fixing portion 25 may have about four times of the measured value, i.e., 260 to 340 kg. Conversely, embodiments having the first connecting portion 13, the first fixing portion 15, the second connecting portion 23, the second fixing portion 25, the third connecting portion 33, the third fixing portion 35, the fourth connecting portion 43, and the fourth fixing portion 45 may have about eight times of the measured value, i.e., 520 to 680 kg.

In conventional, to pack a plate device, polystyrene foam blocks are applied to the periphery of the plate device 500. In this situation, about twelve 60-inches LCD TV sets can be stacked without getting broken. If the polystyrene foam blocks are replaced by paper pulps, at most six 60-inches LCD TV sets can be stacked without getting broken. In practice, in the stores, the bottommost TV set may be broken even when six TV sets are stacked. As shown in FIG. 8, in the packing buffering device 1, the first connecting portion 13, the first fixing portion 15, the second connecting portion 23, and the second fixing portion 25 are arranged as a peripteral structure to form a vertical stress path to transmit the stress to ground. For the TV sets assembled with the hollow paper tubes each with an inner diameter of 38 mm, an outer diameter of 44 mm, and a length of 127 mm (5 feet), about nine 60-inches LCD TV sets can be stacked without getting broken. Furthermore, the first body 11 and the second body 21 are provided as patand structures for bearing the force applied to the TV sets and for holding the TV sets.

As shown in FIGS. 5 to 7, in the packing buffering device 1, the first connecting portion 13, the first fixing portion 15, the second connecting portion 23, the second fixing portion 25, the third connecting portion 33, the third fixing portion 35, the fourth connecting portion 43, and the fourth fixing portion 45 are arranged as a peripteral structure, and the first body 11, the second body 21, the third body 31, and the fourth body 41 are provided as patand structures for bearing the force applied to the objects assembled with the packing buffering device 1. In this situation, about eighteen 60-inches LCD TV sets can be stacked without getting broken, and the performance of the packing buffering device 1 is better than that of the conventional.

Accordingly, when the packing buffering device 1 is provided with the first connecting portion 13, the first fixing portion 15, the second connecting portion 23, the second fixing portion 25, the third connecting portion 33, the third fixing portion 35, the fourth connecting portion 43, and the fourth fixing portion 45, the packing buffering device 1 can provide a relatively higher compression strength to the plate device 500, so that a number of plate devices 500 can be stacked without getting broken. Therefore, the spaces of the container can be utilized in an efficient and convenient manner, and the damage of the plate device 500 due to overload-stacking occurred in the store can be reduced.

Furthermore, for the TV sets assembled with the hollow paper tubes each with an inner diameter of 50 mm, an outer diameter of 56 mm, and a length of 127 mm (5 feet), about twelve 60-inches LCD TV sets can be stacked without getting broken with the embodiment of FIG. 8. Conversely, with the embodiments of FIGS. 5 to 7, for the TV sets assembled with the same hollow paper tubes, about twenty four 60-inches LCD TV sets can be stacked without getting broken. Therefore, the stacking operation can be accomplished with a single pallet, and the forklift can be applied to move the pallet and the goods into the container without manual rearrange operation or using two or more pallets. Accordingly, more plate devices 500 may be received in a freight container. Moreover, the time and the labor cost for charging or discharging the goods can be reduced. Further, the number of the used pallets for one delivery can be reduced, and the pallets to be recycled after the delivery operation can be reduced as well. Hence, the logistics processes can be simplified, the available capacity of a single freight container can be increased, the number of damage plate devices during the manual charging, discharging, delivery, or unpacking in the stores can be reduced, and the sunk cost and the marketing costs can be reduced.

The foregoing flexural strengths and the compression strengths of the first hollow connecting rod 10, the second hollow connecting rod 20, the third hollow connecting rod 30, and the fourth hollow connecting rod 40 are provided as illustrative purposes. In practice, materials with proper shapes and properties may be selected for manufacturing the hollow connecting rods, for example, the hollow connecting rods may be manufactured by degradable plastic rectangular tubes.

As mentioned in the foregoing embodiments, the first hollow connecting rod 10, the second hollow connecting rod 20, the third hollow connecting rod 30, the fourth hollow connecting rod 40, the first buffering pad 61, the second buffering pad 62, and the third buffering pad 63 may be made of paper pulps. Therefore, these components not only can be degradable and recyclable but also have sufficient flexural strength and compression strength. Therefore, these components can allow the force applied to the plate body 510 to be dispersed and buffered, so that the stress and the impact on the plate body 510 can be reduced.

Figure 9:
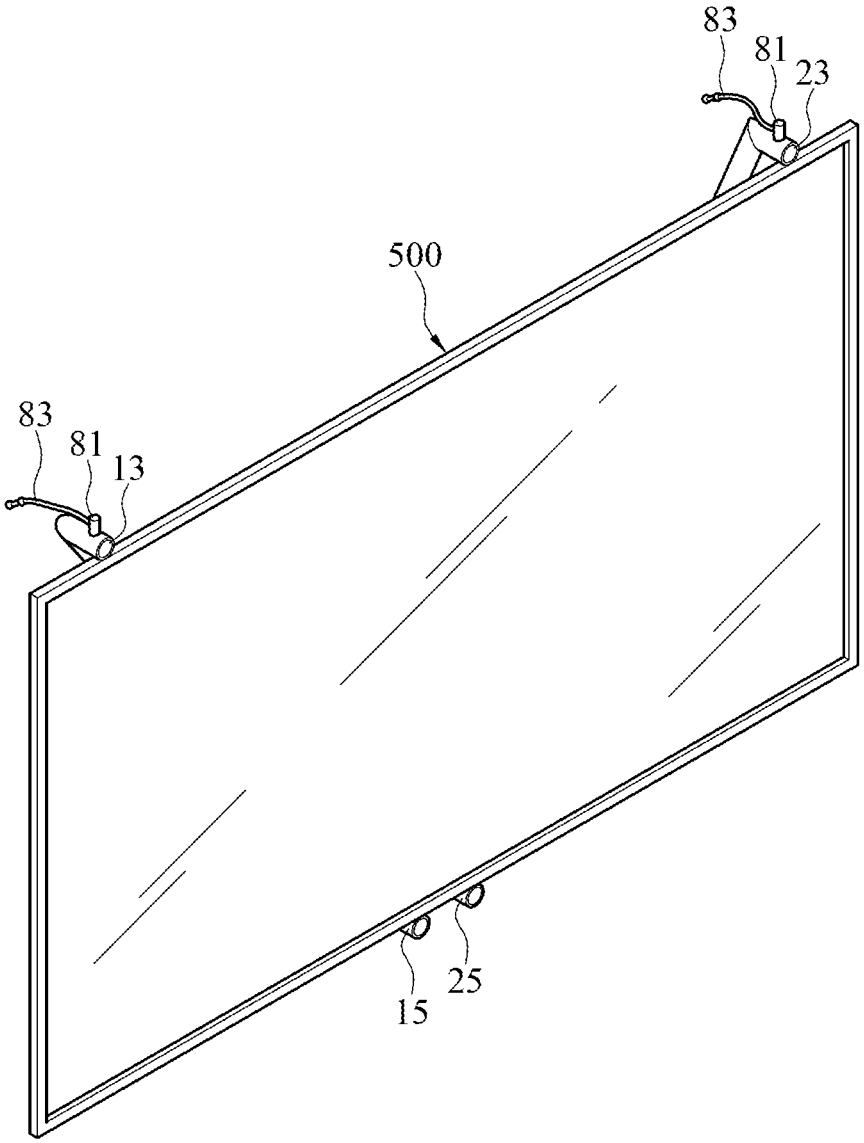
FIG. 9 illustrates an operational view of the packing buffering device of one embodiment.
Figure 10:
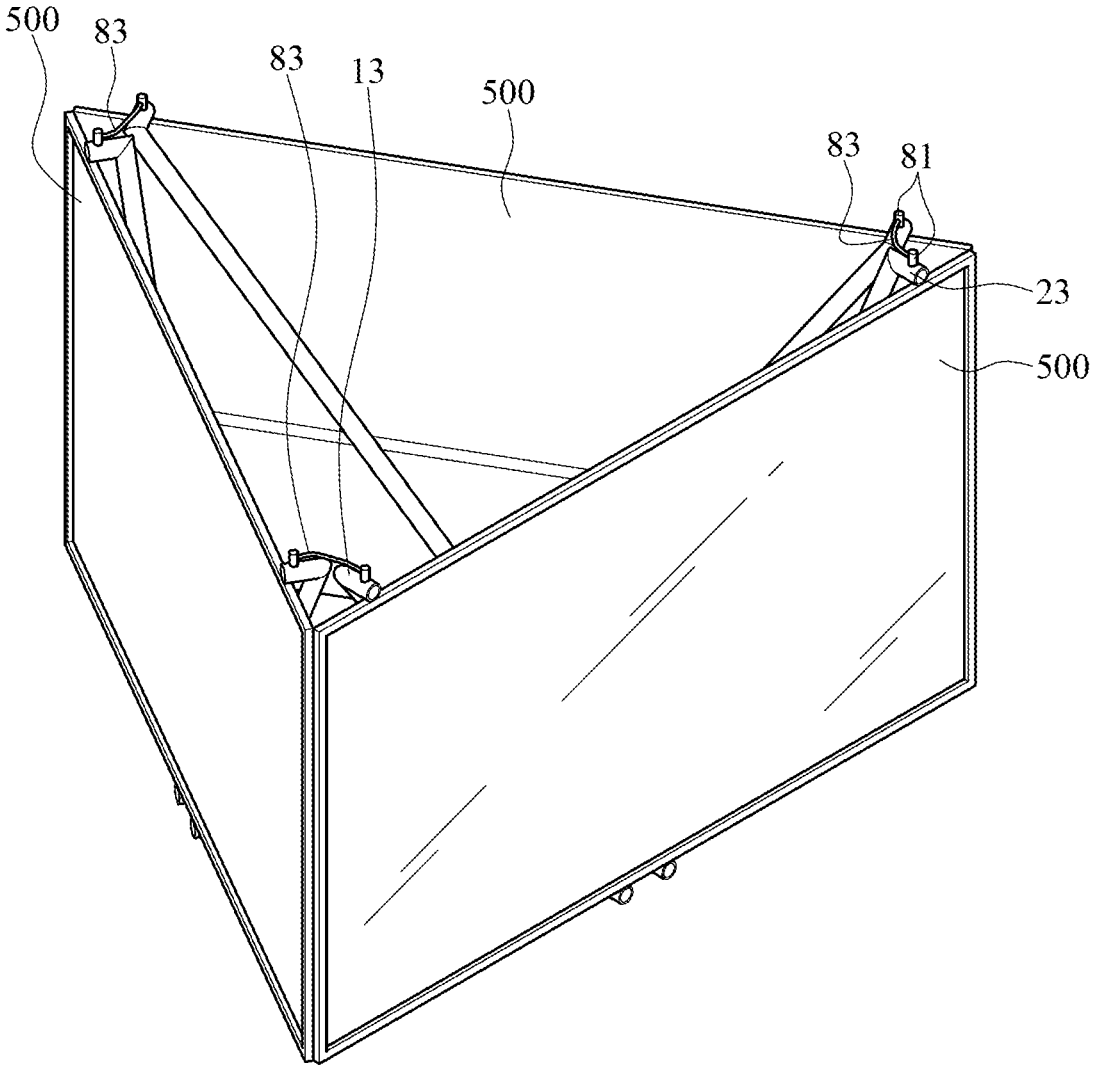
FIG. 10 illustrates another operational view of the packing buffering device of another embodiment.
Figure 11:
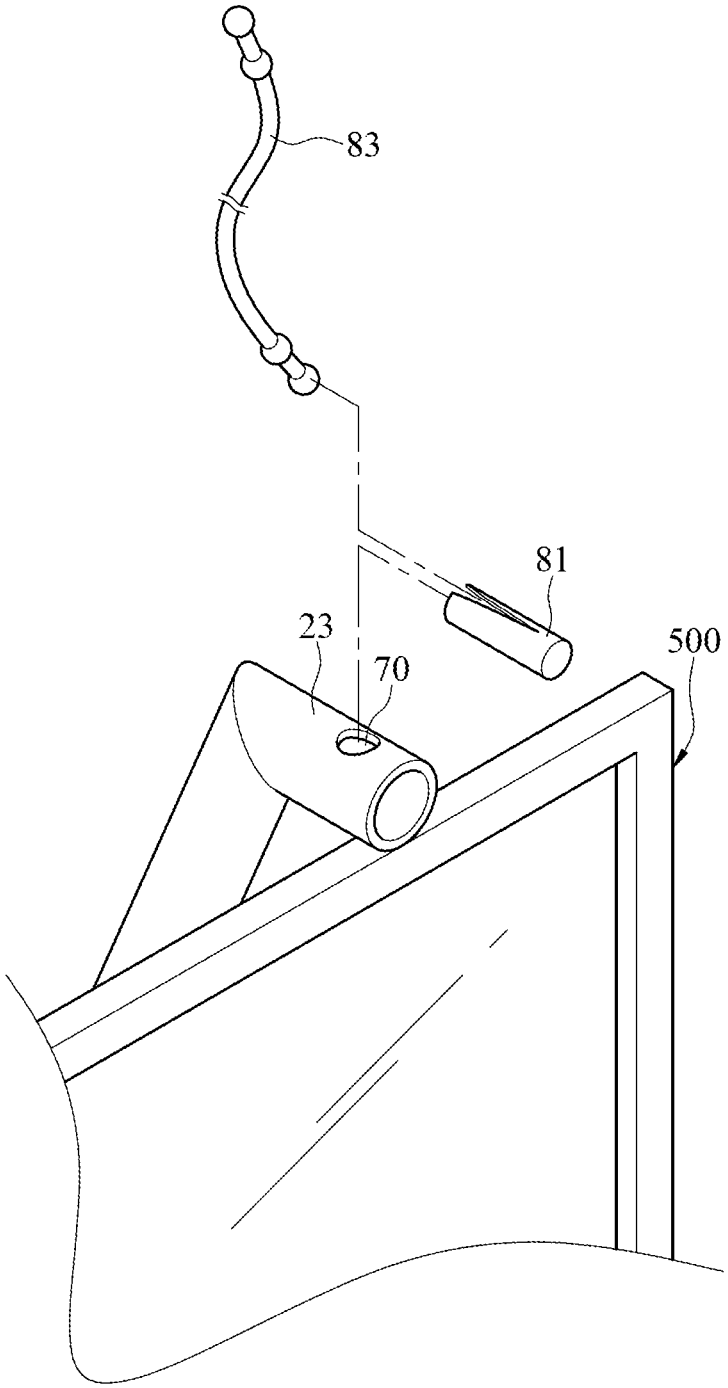
FIG. 11 illustrates a partial enlarged view of the packing buffering device of one embodiment.

FIG. 9 illustrates an operational view of the packing buffering device of one embodiment. FIG. 10 illustrates another operational view of the packing buffering device of another embodiment. FIG. 11 illustrates a partial enlarged view of the packing buffering device of one embodiment. As shown in FIGS. 9 to 11, at least one of the first connecting portion 13, the second connecting portion 23, the first fixing portion 15, and the second fixing portion 25 has an opening 70. In this embodiment, the first connecting portion 13 and the second connecting portion 23 have openings 70, but embodiments are not limited thereto. Furthermore, the packing buffering device 1 further comprises at least one positioning pin 81 and at least one string 83. A portion of the string 83 is in the opening 70 and a slit of the positioning pin 81, and the positioning pin 81 is inserted into the opening 70 to fix the string 83 in the opening 70. As shown in FIG. 10, when the plate device 500 is tested for the aging test or when the plate device 500 is displayed in the store, the string 83 is utilized to position several plate devices 500 with the grouping structure formed by the respective packing buffering devices 1. Therefore, the plate devices 500 can be prevented from being falling off and from being damaged or broken. Moreover, as shown in FIG. 11, when the plate device 500 is tested for the aging test or when the plate device 500 is displayed in the store, the packing buffering device 1 allow the plate device 500 to be fixed with a backboard, a wall, or a display window.

In some other embodiments, the frame 530 of the plate device 500 has an opening 70, e.g., the housing of the LCD TV set has thread holes. A portion of one end of the string 83 of the packing buffering device 1 can be received in the opening 70 and the slit of the positioning pin 81, and the positioning pin 81 is inserted into the opening 70 to position the string 83 in the opening 70. Therefore, the packing buffering device 1 is connected with the plate device 500 through the string 83, and the plate device 500 is fixed in the space provided by the packing buffing device 1. Hence, fewer amounts of paper pulps are used to make the packing buffering device 1 for separating the plate device 500 without the use of conventional buffering materials like polystyrene foam blocks and plastics. Moreover, in the conventional, the packing materials are in direct contact with the objects while the packing buffering device 1 is not in direct contact with the objects.

According to some embodiments of the instant disclosure, the flexural strength and the compression strength of the packed product can be improved by the hollow connecting rods of the packing buffering device, and the packing buffering device can disperse the stress and reduce the impact on the product. Therefore, the packing buffering device can prevent the breaking of the plate device due to the concentration of the stresses on the plate device. Hence, the ratio of defect products and productive man-hour can be reduced. Furthermore, the available capacity of a single freight container can be increased, so that the charging and discharging or the goods can be accomplished via automated processes to reduce the marketing costs. Furthermore, the packing buffering device may be made of recyclable or natural-degradable materials to reduce the environmental pollutions. Hence, fewer amounts of paper pulps are used to make the packing buffering device 1 for achieving the same buffering effect as compared with the conventional.

What is claimed is:

1. A packing buffering device adapted to supporting a plate device, wherein the plate device comprises a plate body and a frame, the frame surrounds a periphery of the plate body and a height of the frame is greater than a height of the plate body, wherein the packing buffering device comprises:

a first hollow connecting rod, comprising a first body, a first connecting portion, and a first fixing portion, wherein the first connecting portion is extended and bent from one of two ends of the first body, and the first connecting portion is in contact with the frame, the first fixing portion is extended and bent from the other end of the first body opposite to the first connecting portion, and the first fixing portion is in contact with the frame, the first body is above the plate body and not in contact with the plate body; and a second hollow connecting rod, comprising a second body, a second connecting portion, and a second fixing portion, wherein the second connecting portion is extended and bent from one of two ends of the second body, and the second connecting portion is in contact with the frame, the second fixing portion is extended and bent from the other end of the second body opposite to the second connecting portion, and the second fixing portion is in contact with the frame, the second body is above the plate body and not in contact with the plate body, wherein the first fixing portion and the second fixing portion are at one of two opposite edges of the plate device, the first connecting portion and the second connecting portion are at the other edge of the plate device opposite to the first fixing portion and the second fixing portion, and a distance between the first fixing portion and the second fixing portion is less than a distance between the first connecting portion and the second connecting portion.

2. The packing buffering device according to claim 1, wherein the frame comprises a first side wall, a second side wall, a third side wall, and a fourth side wall, wherein the first side wall and the second side wall are respectively connected to the third side wall and the fourth side wall, the first side wall is opposite to the second side wall, and the first fixing portion and the second fixing portion are in contact with the second side wall.

3. The packing buffering device according to claim 2, wherein the first connecting portion and the second connecting portion are in contact with the first side wall.

4. The packing buffering device according to claim 2, further comprising:

a third hollow connecting rod, comprising a third body, a third connecting portion, and a third fixing portion, wherein the third connecting portion is extended and bent from one of two ends of the third body, and the third connecting portion is in contact with the first side wall of the frame, the third fixing portion is extended and bent from the other end of the third body opposite to the third connecting portion, and the third fixing portion is in contact with the second side wall of the frame, the third body is above the plate body and not in contact with the plate body; and a fourth hollow connecting rod, comprising a fourth body, a fourth connecting portion, and a fourth fixing portion, wherein the fourth connecting portion is extended and bent from one of two ends of the fourth body, and the fourth connecting portion is in contact with the first side wall of the frame, the fourth fixing portion is extended and bent from the other end of the fourth body opposite to the fourth connecting portion, and the fourth fixing portion is in contact with the second side wall of the frame, the fourth body is above the plate body and not in contact with the plate body;

wherein the third body, the fourth body, the first body, and the second body are at a same side of the plate device, the third body and the fourth body are between the first body and the second body, and a distance between the third fixing portion and the fourth fixing portion is greater than a distance between the third connecting portion and the fourth connecting portion.

5. The packing buffering device according to claim 4, wherein the first connecting rod, the second connecting rod, the third connecting rod, and the fourth connecting rod are paper tubes.

6. The packing buffering device according to claim 5, wherein a flexural strength of each of the first body, the second body, the third body, and the fourth body is in a range from 8 to 30 kg.

7. The packing buffering device according to claim 5, wherein a compression strength of each of the first connecting portion, the first fixing portion, the second connecting portion, the second fixing portion, the third connecting portion, the third fixing portion, the fourth connecting portion, and the fourth fixing portion is in a range from 65 to 85 kg.

8. The packing buffering device according to claim 2, wherein the first connecting portion is at a connection between the first side wall and the third side wall, and the second connecting portion is at a connection between the first side wall and the fourth side wall.

9. The packing buffering device according to claim 8, further comprising a first buffering pad, a second buffering pad, and a third buffering pad, wherein the first buffering pad is at the connection between the first side wall and the third side wall, the second buffering pad is at the connection between the first side wall and the fourth side wall, the third buffering pad is at the second side wall, the first connecting portion is engaged with the first buffering pad, the second connecting portion is engaged with the second buffering pad, and the first fixing portion and the second fixing portion are engaged with the third buffering pad.

10. The packing buffering device according to claim 9, wherein the first buffering pad has a first slot, a first portion of the first body and the first connecting portion are received in the first slot, the second buffering pad has a second slot, a first portion of the second body and the second connecting portion are received in the second slot, the third buffering pad has two third slots, a second portion of the first body and the first fixing portion are received in one of the two third slots, and a second portion of the second body and the second fixing portion are received in the other third slot.

11. The packing buffering device according to claim 1, wherein at least one of the first connecting portion, the second connecting portion, the first fixing portion, and the second fixing portion has an opening, the packing buffering device further comprises at least one positioning pin and at least one string, a portion of the string is in the opening, and the positioning pin is inserted into the opening to fix the string in the opening.

12. The packing buffering device according to claim 1, further comprising:

a third hollow connecting rod, comprising a third body, a third connecting portion, and a third fixing portion, wherein the third connecting portion is extended and bent from one of two ends of the third body, and the third connecting portion is in contact with the frame, the third fixing portion is extended and bent from the other end of the third body opposite to the third connecting portion, and the third fixing portion is in contact with the frame; and a fourth hollow connecting rod, comprising a fourth body, a fourth connecting portion, and a fourth fixing portion, wherein the fourth connecting portion is extended and bent from one of two ends of the fourth body, and the fourth connecting portion is in contact with the first side wall of the frame, the fourth fixing portion is extended and bent from the other end of the fourth body opposite to the fourth connecting portion, and the fourth fixing portion is in contact with the second side wall of the frame;

wherein the first body and the second body are at one of two sides of the plate device, the third body and the fourth body are at the other side of the plate device opposite to the first body and the second body, and the third body and the fourth body are not in contact with the plate body.

13. The packing buffering device according to claim 12, wherein a projection of the third body and a projection of the first body are parallel in a vertical direction, a projection of the fourth body and a projection of the second body are parallel in the vertical direction, and a distance between the third fixing portion and the fourth fixing portion is less than a distance between the third connecting portion and the fourth connecting portion.

14. The packing buffering device according to claim 12, wherein a projection of the third body and a projection of the first body are crossed in a vertical direction, a projection of the fourth body and a projection of the second body are crossed in the vertical direction, and a distance between the third fixing portion and the fourth fixing portion is greater than a distance between the third connecting portion and the fourth connecting portion.

* * * * *